US006663836B1

(12) United States Patent
Kalmakis et al.

(10) Patent No.: US 6,663,836 B1
(45) **Date of Patent: *Dec. 16, 2003**

(54) APPARATUS AND METHOD FOR ALPHANUMERICALLY IDENTIFYING AND ARRANGING TEST TUBES

(75) Inventors: George P. Kalmakis, Reading, MA (US); R. Laurence Keene, Andover, MA (US)

(73) Assignee: Matrix Technologies Corporation, Hudson, NH (US)

( * ) Notice: Subject to any disclaimer, the term of this patent is extended or adjusted under 35 U.S.C. 154(b) by 287 days.

This patent is subject to a terminal disclaimer.

(21) Appl. No.: 09/756,521

(22) Filed: Jan. 8, 2001

Related U.S. Application Data

(63) Continuation-in-part of application No. 08/720,723, filed on Oct. 2, 1996, now Pat. No. 6,171,554.

(51) Int. Cl.[7] ..... B01L 9/00

(52) U.S. Cl. ..... 422/104; 422/99; 422/102; 422/913; 422/915; 216/443

(58) Field of Search ..... 422/62–67, 99, 422/102, 104, 913, 915; 436/43–48, 174, 56; 156/384, 387, 388, 538, 539; 206/443

(56) References Cited

U.S. PATENT DOCUMENTS

| | | | | |
|---|---|---|---|---|
| 3,818,188 A | | 6/1974 | Hertel et al. | |
| 4,238,452 A | * | 12/1980 | McMorrow | 422/104 |
| 4,457,688 A | * | 7/1984 | Calvert et al. | 425/525 |
| 5,098,661 A | | 3/1992 | Froehlich et al. | |
| 5,215,376 A | * | 6/1993 | Schulte et al. | 366/348 |
| 5,357,095 A | | 10/1994 | Weyrauch et al. | |
| 5,393,582 A | * | 2/1995 | Wang et al. | 428/34.2 |
| 5,397,542 A | | 3/1995 | Nelms et al. | |
| 5,420,408 A | | 5/1995 | Weyrauch et al. | |
| 5,427,743 A | | 6/1995 | Markin | |
| 5,439,826 A | * | 8/1995 | Kontorovich | 436/50 |
| 5,688,361 A | * | 11/1997 | Itoh | 156/362 |
| 5,893,263 A | * | 4/1999 | Matsumoto et al. | 156/387 |
| 6,136,273 A | * | 10/2000 | Seguin et al. | 422/99 |
| 6,155,025 A | * | 12/2000 | Komiya et al. | 53/147 |
| 6,171,554 B1 | * | 1/2001 | Kalmakis et al. | 422/104 |
| 6,277,630 B1 | * | 8/2001 | Brophy et al. | 435/288.4 |
| 6,325,129 B1 | * | 12/2001 | Wright et al. | 156/538 |
| 6,372,293 B1 | * | 4/2002 | Mathus et al. | 427/271 |
| 6,402,369 B1 | * | 6/2002 | Ludington et al. | 374/13 |

FOREIGN PATENT DOCUMENTS

| | | |
|---|---|---|
| EP | 0061298 A1 | 9/1982 |
| EP | 0657658 A1 | 6/1995 |
| GB | 227277 | 1/1925 |
| GB | 847650 | 9/1960 |
| GB | 1031032 | 5/1966 |
| GB | 1211710 | 11/1970 |

* cited by examiner

*Primary Examiner*—Jill Warden
*Assistant Examiner*—Dwayne K Handy
(74) *Attorney, Agent, or Firm*—Samuels, Gauthier & Stevens

(57) ABSTRACT

A method of uniquely identifying a plurality of discrete test tubes. The method includes providing a rack having an array of wells located at the intersections of mutually perpendicular columns and rows. The rack is marked to orient the rack from top to bottom and left to right. Each well is identifiable by reference to a sequence of letters and numbers identifying its respective intersecting column and row. A plurality of test tubes are positioned in the wells. The test tubes have open tops and closed lower ends protruding through the open bottoms of the wells. Indicia are applied to the respective closed lower ends of the test tubes positioned in the wells. The application of the indicia is performed in situ and simultaneously as a single step to all of the test tubes in the wells, thereby resulting in each test tube being uniquely identified with reference to its respective well.

9 Claims, 7 Drawing Sheets

APPARATUS AND METHOD FOR ALPHANUMERICALLY IDENTIFYING AND ARRANGING TEST TUBES

CROSS REFERENCE TO RELATED APPLICATIONS

This application is a continuation-in-part (CIP) of application designated Ser. No. 08/720,723, filed Oct. 2, 1996, now issued as U.S. Pat. No. 6,171,554 B1 and entitled "Apparatus And Method For Alphanumerically Identifying And Arranging Test Tubes".

BACKGROUND OF THE INVENTION

1. Field of the Invention

This invention relates to laboratory technology and specifically to a new and improved rack of test tubes suitable for use in diagnostic methods.

2. Background of the Invention

It is known to provide multi-well racks for test tubes. Conventionally, the wells may be located at the intersections of mutually perpendicular columns and rows aligned with 1AS alphanumeric markings along perpendicular edges of the rack. Alternatively, instead of employing alphanumeric markings along the rack edges, in order to assist laboratory personnel in properly orienting the racks, markings may be applied at a corner as shown, for example, at 42 in FIG. 5, or a corner of the rack may be chamfered as shown at 44 in FIG. 6. Test tubes are supported in the wells. If the tubes are not labeled, and if more than one tube is removed from the rack at any given time, errors may be made when returning the tubes to the rack. The tubes may also be manually marked with an alphanumerical designation to identify their appropriate positions in the array of wells. In addition to being time consuming and laborious, this practice can also lead to errors caused by laboratory technicians either mislabeling the tubes or again, returning properly labeled tubes to the wrong wells.

SUMMARY OF THE INVENTION

In one embodiment of the present invention, these problems are avoided, or at least significantly minimized, by simultaneously marking all of the test tubes in a given rack with alphanumeric indicia corresponding to the alphanumeric indicia identifying the wells within which the test tubes are to be located. Preferably, the wells are open bottomed to expose the lower tube ends, and the alphanumeric markings are applied to the thus exposed tube bottoms.

Alternatively, the racks may be oriented by reference to visible features, e.g., corner markings or chamfers.

The wells may have closed bottoms, in which case the tubes are marked prior to being placed in the racks.

A matrix of tubes may be assembled on mandrels, indicia printed on the matrix of tubes, and the entire matrix then transferred into a rack such that each tube is located in its predetermined location.

In still another embodiment, the tubes may be marked with a laser before being placed in either a labeled or unlabeled rack.

BRIEF DESCRIPTION OF THE DRAWINGS

FIG. 8 is a perspective view of a set mandrels having several test tubes placed on some of the mandrels.

DETAILED DESCRIPTION OF THE PREFERRED EMBODIMENTS

Figure 1:
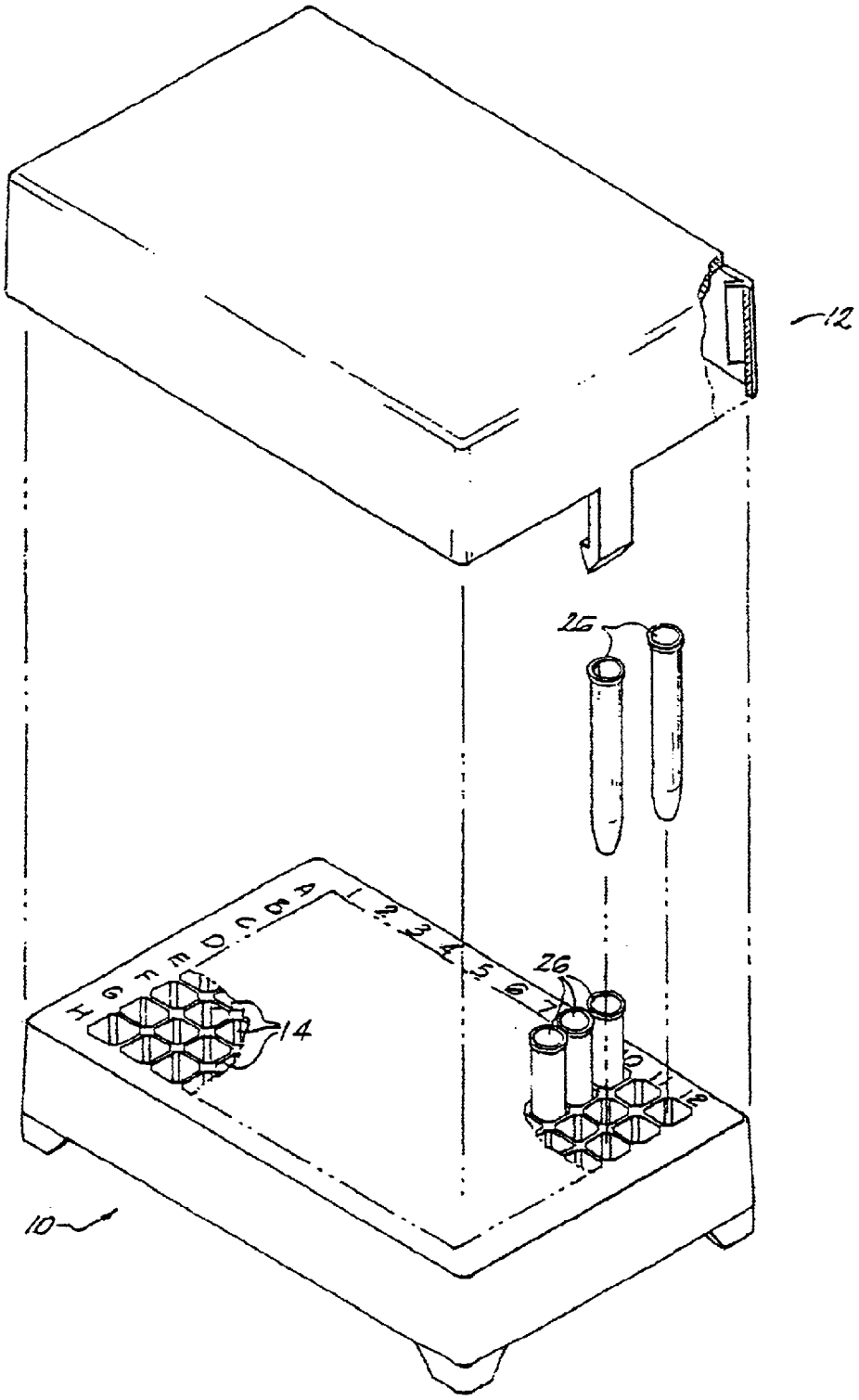
FIG. 1 is a view of a rack of tubes in accordance with the present invention with the lid and several individual tubes depicted in an exploded relationship.
Figure 2:
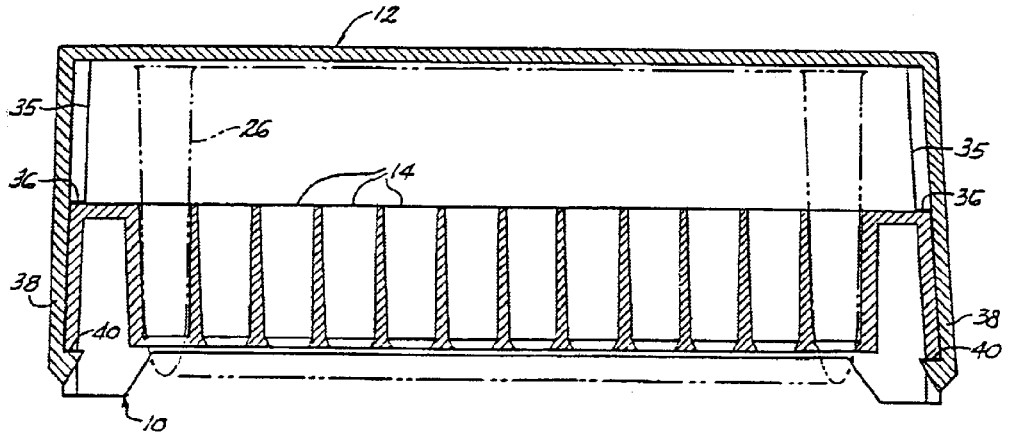
FIG. 2 is an enlarged cross-section of the rack and assembled lid.
Figure 3:
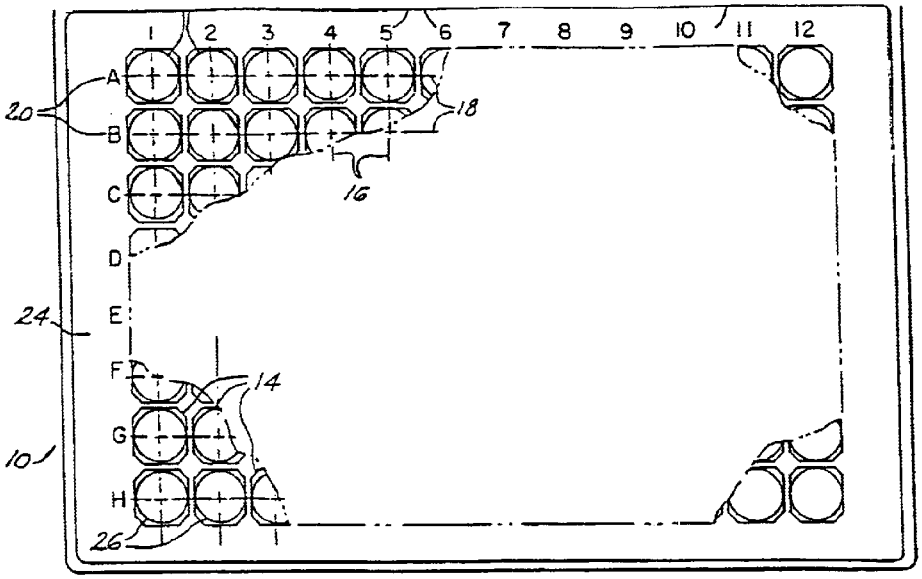
FIG. 3 is a top plan view of the rack of tubes with the lid removed.

Referring initially to FIGS. 1–4, a rack of tubes in accordance with the present invention is shown generally at 10 with its associated lid 12. The rack 10 includes wells indicated typically at 14. As shown in FIG. 3, the wells 14 are located at the intersections of mutually perpendicular columns 16 and rows 18 aligned with alphanumeric markings 20 along perpendicular edges 22, 24 of the top surface of the rack. In the illustrated embodiment, each column 16 is labeled with a number and each row is labeled with a letter to define the position of each well 14.

Figure 4:
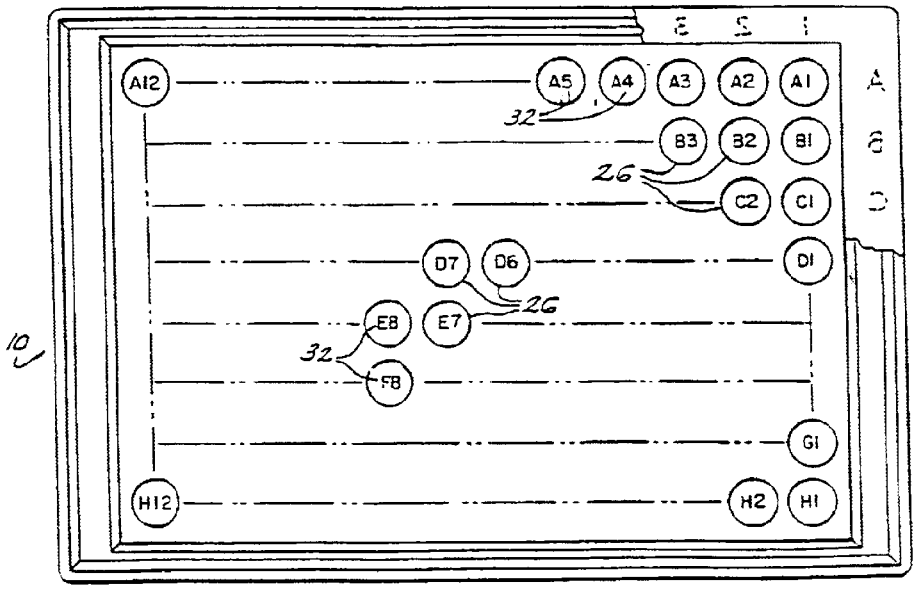
FIG. 4 is a bottom plan view of the rack of tubes.

The wells 14 are configured and dimensioned to support test tubes indicated typically at 26. The bottom ends of the test tubes protrude through the open bottoms of the wells and are thus exposed, as shown in FIGS. 2 and 4. The exposed tube ends are marked, as by printing, with alphanumeric indicia indicated typically at 32 corresponding to the alphanumeric locations of the wells in which the tubes 26 are supported. The lid 12 is detachably mounted on the rack 10 to keep the tubes 26 in place, both during as well as after applying the indicia 32 to the tube ends.

The lid 12 includes internal corner ribs 35 which abut the upper surface of the rack 10 as at 36 to provide a positive locating function. Resilient locking tabs 38 mechanically engage the rack as at 40 to detachably secure the lid in place.

Figure 5:
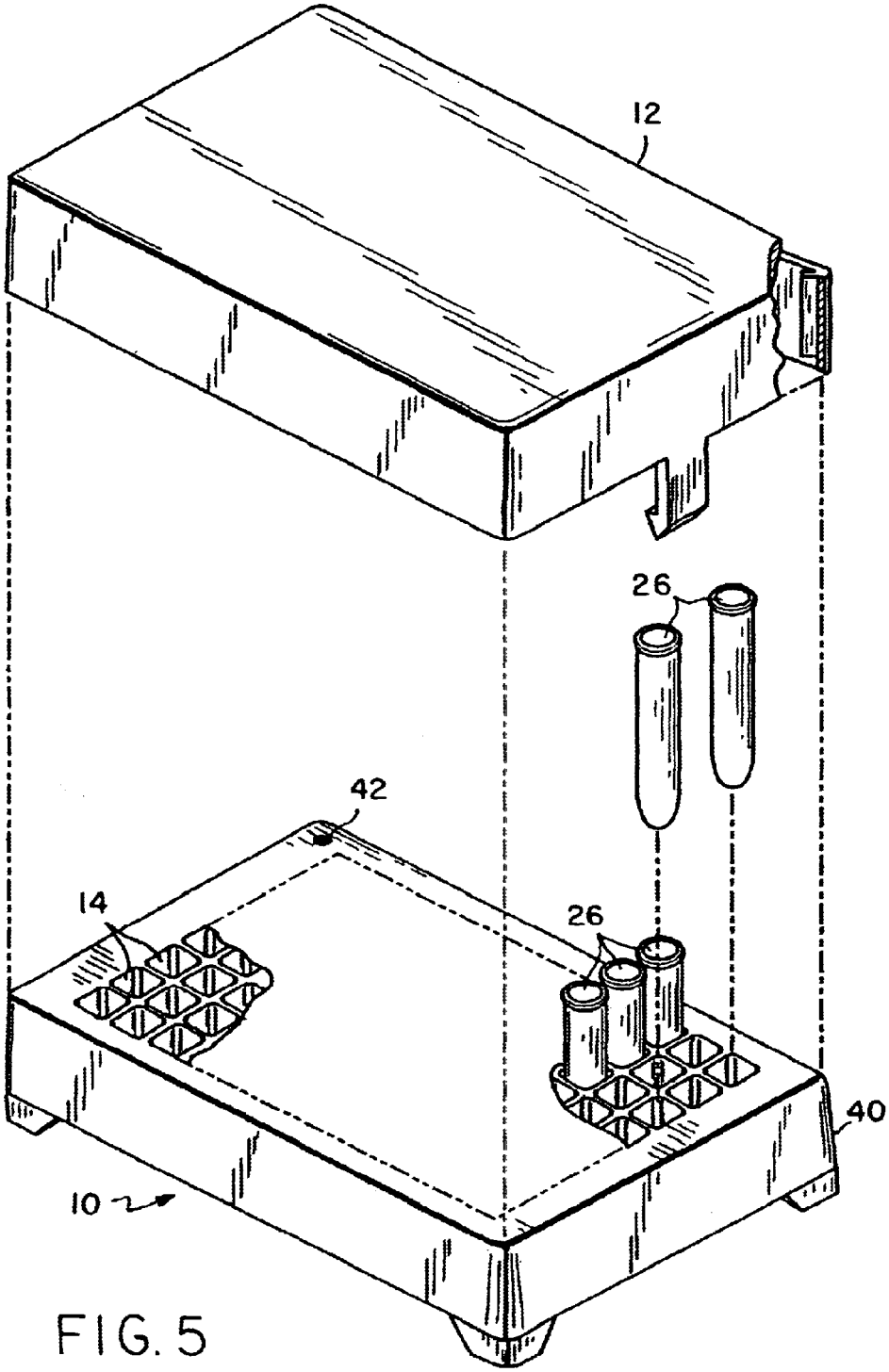
FIG. 5 is a view of an alternative rack of tubes with the lid and several individual tubes depicted in an exploded relationship.
Figure 6:
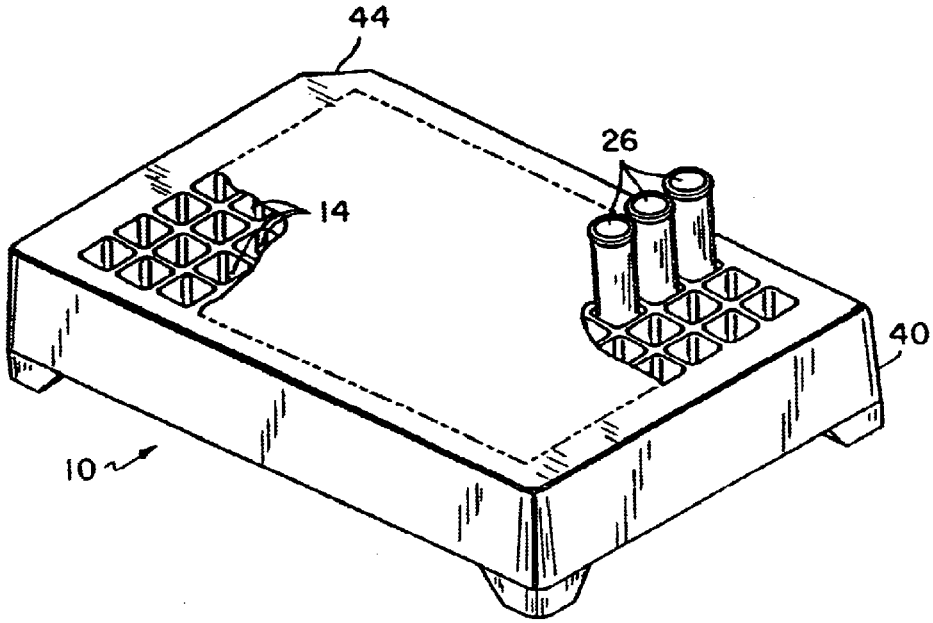
FIG. 6 is a perspective view of another alternative embodiment of the rack.

Some racks 40, disposable carriers and plates do not have alphanumeric markings along the edges thereof to label the columns and/or rows as illustrated in FIGS. 5 and 6. However, it is generally known to laboratory personnel using the racks that the rows are conventionally identified by letters i.e. A, B, C, whereas the columns are identified by numbers, i.e. 1, 2, 3, to define the position of each well 14, the same as for the racks which include the alphanumeric markings. When using a rack or carrier without alphanumeric markings, as previously noted, the rack may be marked as at 44 such as shown in FIG. 5, or chamfered as at 44 as indicated in FIG. 6 to provide an orientation reference.

With reference to the embodiment shown in FIGS. 1–5, the method of applying indicia 32 to the test tubes may comprise the following steps: unmarked test tubes 26 are placed in the wells 14; the lid 12 is secured to the rack; the assembled lid and rack are inverted to expose the lower tube ends; and the lower tube ends are printed with alphanumeric designations corresponding to alphanumeric designations (whether or not printed along the edges 22, 24 of the rack).

Figure 7:
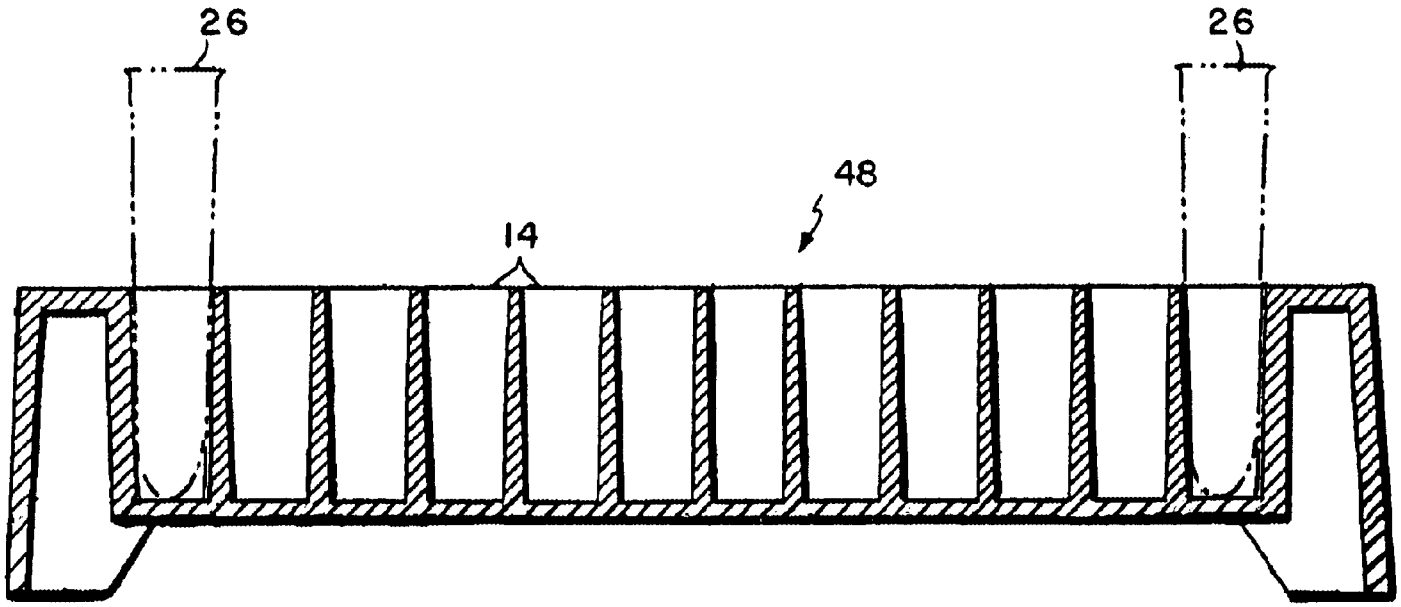
FIG. 7 is an enlarged cross-section view of a closed bottom rack of tubes with the lid removed.
Figure 5:
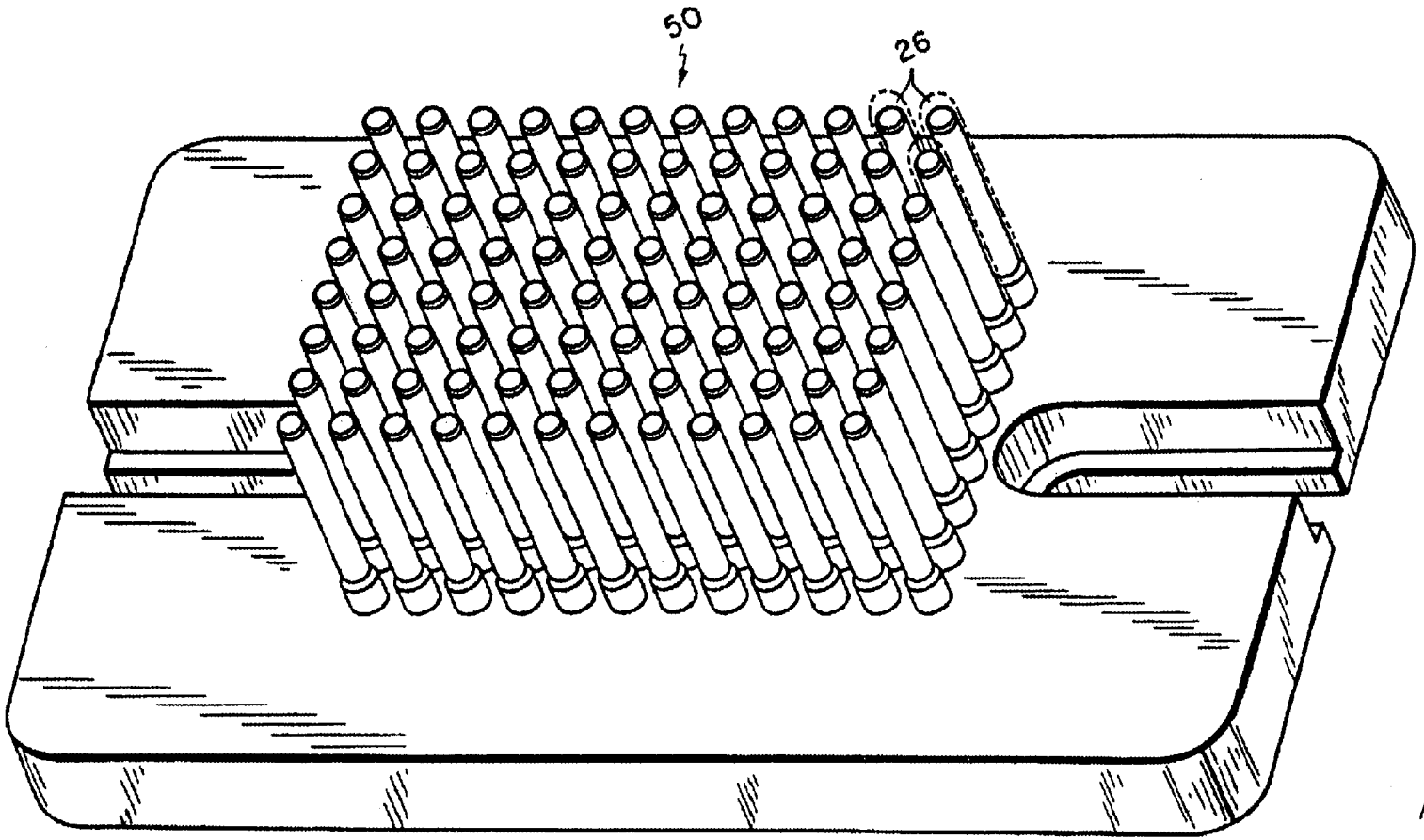

Alternatively, the tubes may first be positioned in a fixture having wells with open bottoms. The tubes are printed as described above, and after printing they are removed as a group from the fixture and placed into a second fixture. The second fixture may be a rack 48 having closed bottomed wells as shown in FIG. 7. The second fixture may also be a cartridge designed to hold the tubes during the printing process. The cartridge may then be provided to laboratory personnel who will employ the cartridge as an insert into racks already in their possession.

In accordance with another embodiment, a matrix of tubes may be assembled on mandrels 50 as shown in FIG. 8. The matrix of tubes may be printed simultaneously then transferred to an open or closed bottom rack with or without alphanumerics along the edges thereof.

When the tubes are printed while they are positioned in the rack or fixture or on the set of mandrels, one eliminates the possibility that a printed tube will be loaded into an incorrect position. Also, as all of the tubes are printed at one time, only one art set-up is required.

Alternatively, the tubes may be individually laser marked and then placed within a rack or carrier in positions which corresponds to their markings.

The tubes may be made of a polymeric material, specifically a polyolefin, and more specifically polypropylene or the tubes may be made of glass. The indicia printed on the tubes should be resistant to solvents, scratching, etc. To this end, the polypropylene tubes preferably are pretreated by corona discharge and placed under a flame before being pad printed. This pretreatment oxidizes the tube surface and this optimizes its receptivity to the printed indicia.

The forgoing description has been limited to a specific embodiment of the invention. It will be apparent, however, that variations and modifications can be made to the invention, with the attainment of some or all of the advantages. For example, the number of wells in the rack may be altered or the array may only include letters rather than numbers or another printing or marking method may be utilized. Therefore, it is the object of the claims to cover all such variations and modifications as come within the true spirit and scope of the invention.

Having described the invention, what is now claimed is:

1. A method of uniquely identifying a plurality of discrete test tubes, said method comprising the steps of:

a) providing a rack having an array of wells with open bottoms, said wells being located at the intersections of mutually perpendicular columns and rows and being configured and dimensioned to receive single test tubes, said rack being marked to orient the rack from top to bottom and from left to right, each column referenced as a sequence of numerals starting with the column furthest to the left and each row starting at the top referenced as a sequence of letters, each well thus being indentifiable by reference to the combination of letters and numbers identifying its respective intersecting column and row;

b) positioning a plurality of said test tubes in said wells, said test tubes having open tops and closed lower ends protruding through the open bottoms of said wells; and c) applying one of said letters and one of said numbers to the respective closed lower ends of each of the test tubes positioned in said wells, with the letter and number applied to the lower end of each test tube corresponding to the letter and number identifying its respective well, and with the application of said letters and numbers being performed in situ and simultaneously as a single step to all of the test tubes in said wells, thereby resulting in each test tube being uniquely identified with reference to its respective well.

2. The method of claim 1, further comprising detachably coupling a lid to said rack.

3. The method of claim 1, wherein said letters and numbers are pad printed.

4. A method of uniquely identifying a plurality of discrete test tubes, said method comprising the steps of:

a) providing a rack having an array of wells with closed bottoms, said wells being located at the intersections of mutually perpendicular columns and rows and being configured and dimensioned to receive single test tubes, b) assigning first indicia to said columns and second indicia to said rows, each well thus being uniquely identifiable by reference to the first and second indicia assigned to its respective intersecting column and row;

c) providing a plurality of test tubes having open top ends and closed lower ends;

d) applying combinations of said first and second indicia as markings to the respective closed lower ends of the test tubes, the indicia applied to the closed lower end of each tube corresponding to the indicia assigned to the intersecting column and row of one of said wells;

e) transferring the marked test tubes into the wells of said rack, with the indicia identifying each test tube corresponding to the indicia identifying its respective well, whereupon each test tube is uniquely identified with reference to its respective well.

5. The method of claim 4, wherein the test tubes are initially assembled on mandrels, marked in situ and simultaneously as a single step on said mandrels before being transferred to said rack.

6. The method of claim 4, wherein the test tubes are laser marked before being transferred to said rack.

7. A method of uniquely identifying a plurality of discrete test tubes, said method comprising the steps of:

a) providing a rack having an array of wells with open bottoms, said wells being located at the intersections of mutually perpendicular columns and rows and being configured and dimensioned to receive single test tubes, said rack having first indicia identifying said columns and second indicia identifying said rows, each well thus being identifiable by reference to the first and second indicia identifying its respective intersecting column and row;

b) providing a plurality of test tubes, each test tube having a closed lower end;

c) marking said first and second indicia to the respective closed lower ends of the test tubes with a laser; and d) positioning the test tubes in corresponding to the wells of said rack, with the indicia applied to the closed lower end of each tube corresponding to the indicia identifying its respective well, thereby resulting in each test tube being uniquely identified with reference to its respective well.

8. A method of uniquely identifying a plurality of test tubes for location in an array of wells in a holding device, said wells being located at the intersection of mutually perpendicular columns and rows, and said test tubes having open tops and closed bottoms, said method comprising:

assigning first indicia to each of said columns and second indicia to each of said rows, with each well thus being identifiable by a unique combination of the first and second indicia assigned to its respective intersecting column and row; and simultaneously applying unique combinations of said first and second indicia to the bottoms of said plurality of test tubes, with the combination of indicia applied to the bottom of each test tube corresponding to the combination of indicia identifying a respective one of said wells.

9. A method of uniquely identifying a plurality of test tubes for location in an array of wells in a holding device, said wells being located at the intersection of mutually perpendicular columns and rows, and said test tubes having open tops and closed bottoms, said method comprising:

providing said holding device with a visible feature;

arranging said holding such that said feature is positioned at a selected orientation;

assigning indicia uniquely identifying each of the wells of the thus arranged holding device, said indicia being in a preselected sequence;

applying corresponding indicia simultaneously to the bottoms of said plurality of test tubes; and filling said wells with said test tubes, with the indicia applied to the bottom of each test tube corresponding to the indicia assigned to its respective well.

* * * * *